US006533131B2

(12) United States Patent
Bada

(10) Patent No.: US 6,533,131 B2
(45) Date of Patent: Mar. 18, 2003

(54) SYSTEM FOR DISPLAYING PRODUCTS FOR SALE

(75) Inventor: Alain Marcel Bada, Saint-Ouen l'Aumone (FR)

(73) Assignee: Plasti-Rapid, Saint Ouen l'Aumone (FR)

( * ) Notice: Subject to any disclaimer, the term of this patent is extended or adjusted under 35 U.S.C. 154(b) by 0 days.

(21) Appl. No.: 09/726,312

(22) Filed: Dec. 1, 2000

(65) Prior Publication Data

US 2001/0002659 A1 Jun. 7, 2001

(30) Foreign Application Priority Data

Dec. 2, 1999 (FR) ..... 99 15184

(51) Int. Cl.[7] ..... A47F 1/04
(52) U.S. Cl. ..... 211/59.2; 211/184
(58) Field of Search ..... 211/59.2, 59.3, 211/184, 175, 151, 189–191, 153; 312/35

(56) References Cited

U.S. PATENT DOCUMENTS 3,703,964 A * 11/1972 Field ..... 211/184
4,395,955 A * 8/1983 Pfeifer ..... 211/184
4,476,985 A * 10/1984 Norberg et al. ..... 211/184
4,712,694 A * 12/1987 Breslow ..... 211/184
4,735,324 A * 4/1988 Wilcek ..... 211/184
4,890,746 A * 1/1990 Trulaske, Jr. ..... 211/59.2
5,082,125 A * 1/1992 Ninni ..... 211/184
5,115,920 A * 5/1992 Tipton et al. ..... 211/59.2
5,295,591 A 3/1994 Slater
5,341,945 A * 8/1994 Gibson ..... 211/184
5,360,122 A 11/1994 Benton
5,582,305 A * 12/1996 Howell, Sr. et al. ..... 211/184
5,593,048 A * 1/1997 Johnson ..... 211/59.2
5,673,801 A * 10/1997 Markson ..... 211/59.3
5,682,824 A * 11/1997 Visk ..... 211/184
5,884,782 A * 3/1999 Dembicks ..... 211/175
5,971,173 A * 10/1999 Valiulis et al. ..... 211/184
6,105,798 A * 8/2000 Gruber et al. ..... 211/151
6,142,317 A * 11/2000 Merl ..... 211/59.3

FOREIGN PATENT DOCUMENTS

FR 2 667 229 4/1992

* cited by examiner

*Primary Examiner*—Daniel P. Stodola
*Assistant Examiner*—Jennifer E. Novosad
(74) *Attorney, Agent, or Firm*—Young & Thompson

(57) ABSTRACT

The system includes in combination two rails spaced for positioning and strips forming cross pieces adapted to secure together the rails. Each rail includes at least one positioning device and one snap-in device.

9 Claims, 4 Drawing Sheets

SYSTEM FOR DISPLAYING PRODUCTS FOR SALE

FIELD OF THE INVENTION

This application corresponds to French application Ser. No. FR 99.15184, filed Dec. 2, 1999, the disclosure of which is incorporated herein by reference.

FIELD OF THE INVENTION

The present invention relates to a device for the display of products for sale, of the type comprising in combination: two spaced positioning rails and strips forming cross pieces adapted to be secured to said rails.

BACKGROUND OF THE INVENTION

For the display of products for sale, in particular in large sales areas, particularly in supermarkets, the present practice is to fix spaced positioning rails to shelves or shelving. These rails are generally crossed by strips, and are adapted to receive products for sale, in a manner known per se.

At present, the emplacement of the rails and the strips on a display shelf or shelving takes place by means of various operations of positioning, piercing or welding.

To overcome these drawbacks, it has been proposed to fix the rails directly by gluing, for example by means of a double faced adhesive to the display panels or shelving. However, this technique does not permit ensuring in a certain manner a good position of the display device, such that in case of lack of parallelism between the rails or lack of parallelism between the strips, there results an unattractive display of the products.

SUMMARY OF THE INVENTION

The invention has for its object to overcome these drawbacks, by providing a new device for displaying products for sale whose rails are adapted to be glued to a display shelf or shelving, whilst ensuring good positioning and an aesthetic display of the products that are for sale.

The invention has for its object a display device for products for sale, of the type comprising in combination: two spaced positioning rails and strips forming cross pieces adapted to be secured to said rails, characterized in that each rail comprises at least one positioning means and at least one snap-in means for a strip.

According to other characteristic advantages of the invention:

- each strip comprises an engagement and positioning head relative to a first rail, so as to engage in the first rail and pivot about its engagement head to be indexed on the second rail,
- each strip comprises an indexing end adapted to index the strip relative to a second rail before the relative snapping in of the strip relative to the two rails,
- each rail comprises a snap-in means comprising at least one configuration forming a mortise and a positioning means that is not coplanar with said snap-in means,
- a first rail has a substantially J shaped cross section, and a second rail has a substantially L shaped cross section,
- the positioning means of the first rail are located on the small leg of the J section and the snap-in means of this first rail are located on the large leg of the J section,
- the positioning means of the second rail are indexing means located on one leg of the L shaped cross section, and the snap-in means of this second rail are located on the other leg of the L shaped section,
- rails and strips are shaped in order to: position each strip relative to a first rail, and pivot each strip relative to this first rail to effect an indexing relative to a second rail,
- the relative snap-in means of the rails and the strips are shaped to interact only after the relative positioning and indexing of the rails and the strips,
- the strips forming cross pieces are adapted to be used as spacing means for the rails for the securement of the rails to a display shelf.

BRIEF DESCRIPTION OF THE DRAWINGS

The invention will be better understood from the description which follows, given by way of non-limiting example, with reference to the accompanying drawings, in which.

DETAILED DESCRIPTION OF THE INVENTION

Figure 1:
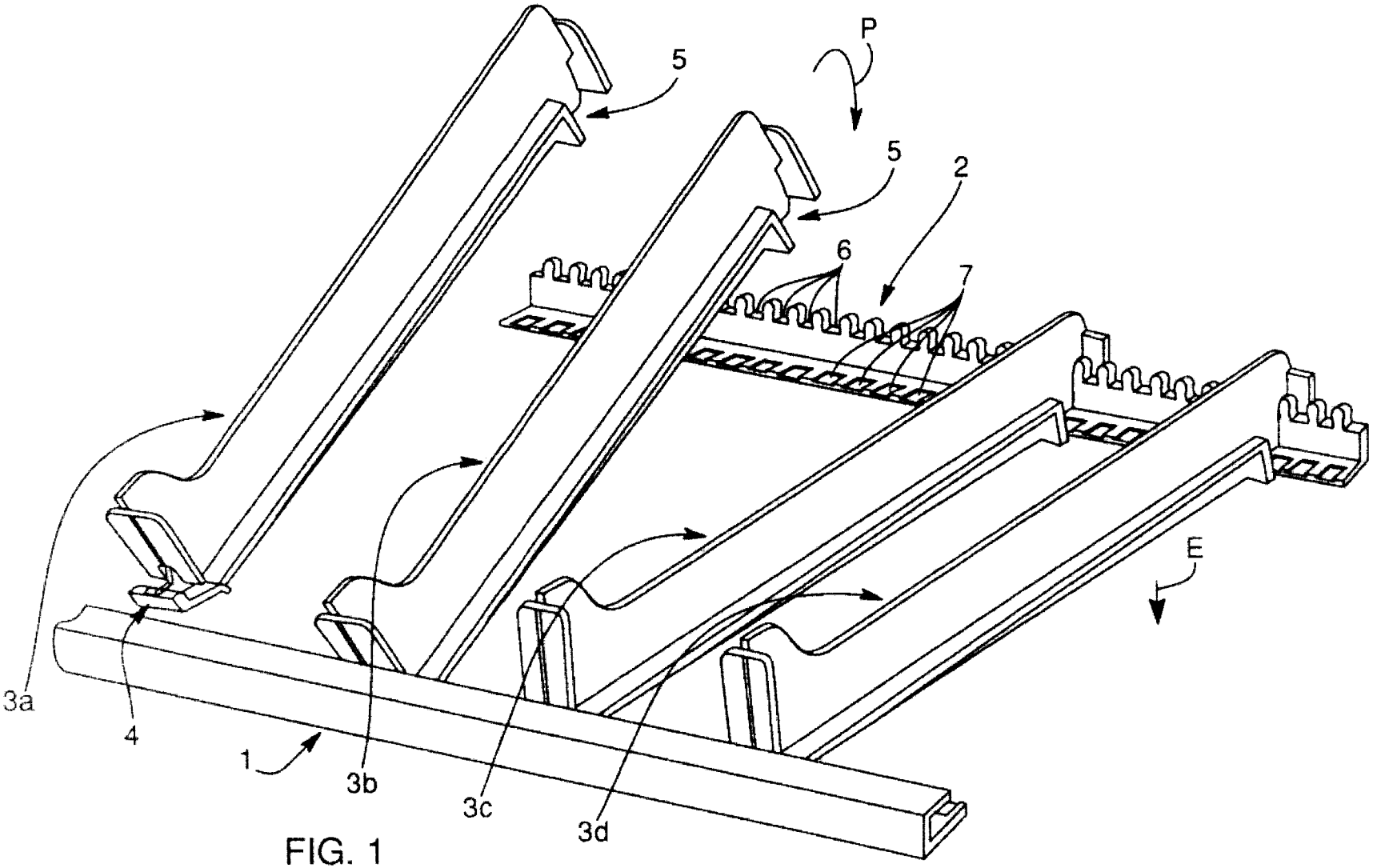
FIG. 1 is a schematic perspective view of a device according to the invention.

Referring to FIGS. 1 to 10, identical reference numerals designate identical or functionally equivalent elements.

In FIG. 1, a device according to the present invention comprises a front rail 1 and a rear rail 2 spaced from each other and adapted to be fixed on a display shelf or shelving (not shown).

Several strips 3*a*, 3*b*, 3*c*, 3*d* are adapted to be fixed securely to the rails 1 and 2.

The strips 3*a* to 3*d* are the strips for separating products to be displayed.

Each strip 3*a* to 3*d* is removable and can be secured to the rails 1 and 2 in a desired position.

The strip 3*a* is shown in the detached position.

The strip 3*b* is inserted by its front end into the rail 1 having a substantially J shaped cross section.

The strip 3*c* has been inserted into the front rail 1 and has been subjected to a pivotal movement P to index it into a selected position on the rear rail 2.

The strip 3*d* has been emplaced like the strip 3*c* and has been subjected to downward snap-in pressure in the direction of the arrow E, so as to be snapped into both the front rail 1 and the rear rail 2.

Each strip 3*a* to 3*d* comprises an engagement head 4 adapted to be inserted in the J section of a rail 1, being positioned therein by coaction with a positioning means of the rail 1. Each strip 3*a* to 3*d* also has a rear indexing end 5 adapted to coact with indexing notches 6 of the rail 2.

As will be described hereafter, the front and rear ends of each strip 3*a* to 3*d* both will have snap-in shapes adapted to coact with the corresponding snap-in shapes 7 provided both on the front rail 1 and on the rear rail 2.

The shape of the front rail 1 can vary and be different from a substantially J shaped section, without departing from the scope of the invention, when this shape permits engagement of a head or an engagement means of a strip 3*a* to 3*d*.

The shape of the rear rail 2, substantially L shaped, can also, without departing from the scope of the invention, be modified while keeping an arrangement permitting pivoting the strip 3 in the direction of the arrow P, and indexing by positioning means or indexing means equivalent to notches 6, and finally snapping in at least this rear rail 2.

Figure 2:
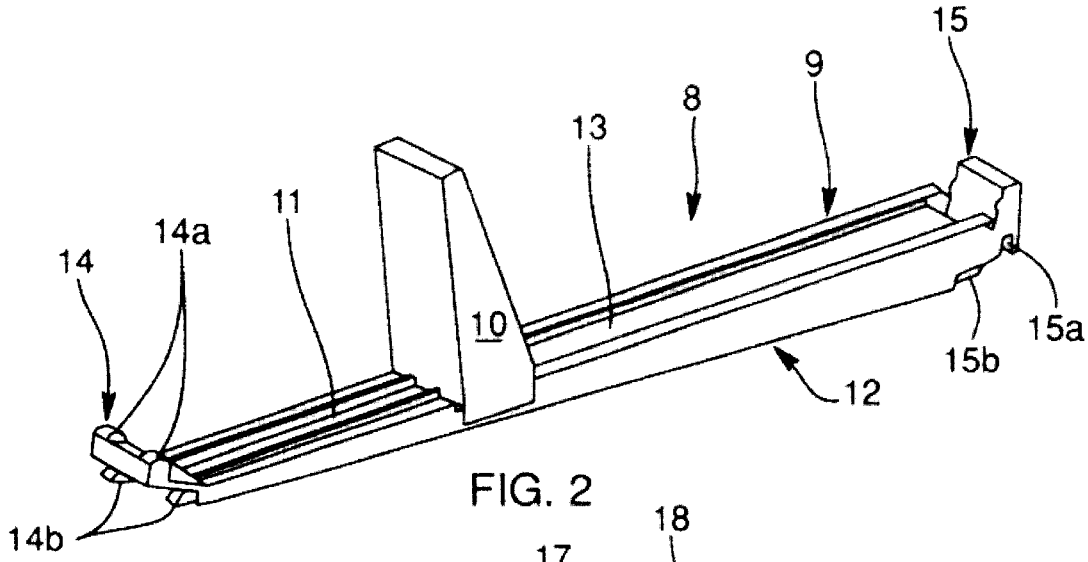
FIG. 2 is a schematic perspective view of a pusher strip of a device according to the invention.

In FIG. 2, a strip 8 forming a pusher of objects or of products to be displayed for sale, comprises a slideway 9 on which slides a pusher 10 urged forwardly by a spiral 11 rolled up within the pusher 10.

The pusher strip 8 comprises a body 12 made of one piece with slide 9.

DETAILED DESCRIPTION OF THE INVENTION

This body 12 comprises two vertical ribs and a floor 13 on which unwinds and rewinds the spring 11. The body 12 also comprises a front end 14 compatible with the engagement and positioning in a front rail 1 and a rear extremity 15 of the indexing and snap-in on rail 2.

The front end 14 comprises two small positioning lugs 14*a* and two male elements 14*b* forming snap-in means.

The rear end 15 comprises, in prolongation of the ribs of the body 12, two indexing hooks 15*a* and two snap-in tenons 15*b*.

Preferably, the pusher strip 8 is comprised by a body 12 injection molded from synthetic material, for example polycarbonate, of a first sliding pusher 10 and of a spring 11 that can be wound up and unwound. The end of the spring 11 is fixed preferably to the front of the pusher 8.

Figure 3:
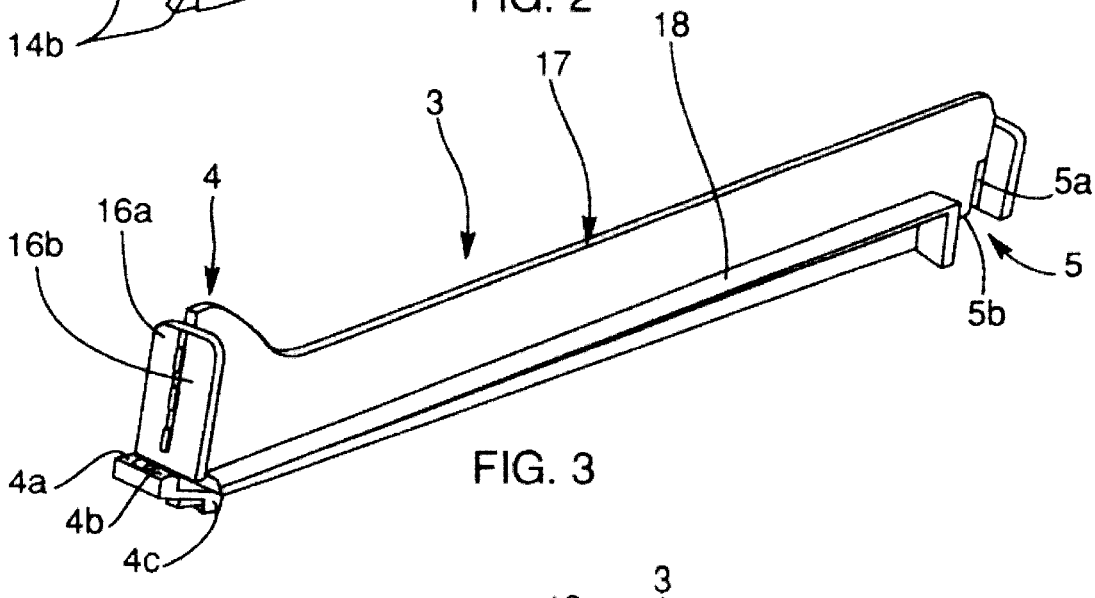
FIG. 3 is a schematic perspective view of a separating strip of a device according to the invention.

In FIG. 3, a separation strip 3 comprises a front end 4 and a rear end 5.

The separation strip 3 has in front a double flap 16*a*, 16*b* of predetermined flexibility to permit engagement or disengagement of products sliding between two separation strips 3.

The front end 4 has a positioning projection 4*a* and a snap-in tenon 4*b*, as well as a pivoting abutment 4*c*.

The rear end 5 comprises an indexing notch 5*a* and a snap-in tenon 5*b*.

Preferably, each separation strip 3 comprises a body 17 having a central rib and two lateral tracks 18 for the sliding of products.

Each lateral track 18 is curved at its rear end at a distance corresponding substantially to the thickness of a pusher 10. This arrangement permits advantageously positioning below the rib 17 a snap-in tenon 5*b* to be adapted to coact with a snap-in mortise 7 of the rear rail 2.

Figure 4:
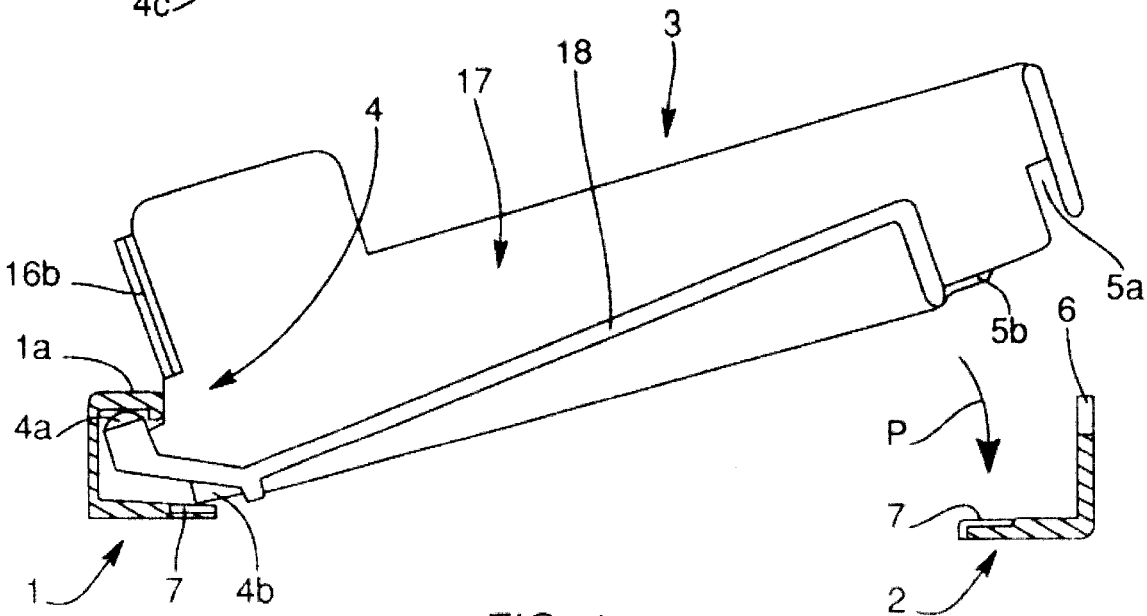
FIG. 4 is a schematic cross sectional view of a device according to the invention illustrating the operation of the invention.

In FIG. 4, after having engaged the front end 4 of a strip 3 in the J shaped configuration of the front rail 1 and positioned the projection 4*a* in a corresponding hollow 1*a* of the front rail 1, the strip can be pivoted in the direction of the arrow P to index the strip 3 relative to the rear rail 2 by inserting the notch 5*a* into the notch 6 of the rear strip 2.

Thanks to the invention, the respective positioning of the strips 3 relative to the front rail 1 and to the rear rail 2 is thus ensured in a reliable and rapid manner.

After having caused the pivoting P, it then suffices to apply a complementary pressure to snap in the tenons 4*b* and 5*b* into the snap-in mortises of the front rail 1 and of the rear rail 2.

The securement of the strips to the rails 1 and 2 thus permits obtaining simply and rapidly an automatic positioning of the device according to the invention on a display shelf or shelving.

Also, this practice of the invention permits, after having emplaced the front rail 1, using the rearward pivoting of several strips 3 suitably to space the rear rail 2 from the front rail 1 and to ensure a perfect parallelism of mounting.

Figure 6:
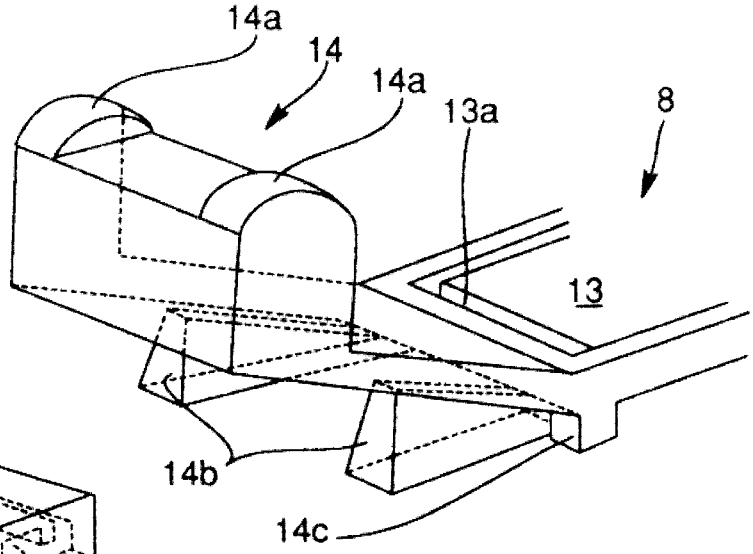
FIGS. 5 to 7 show schematically partial perspective views of forward portions of the device according to the invention.
Figure 5:
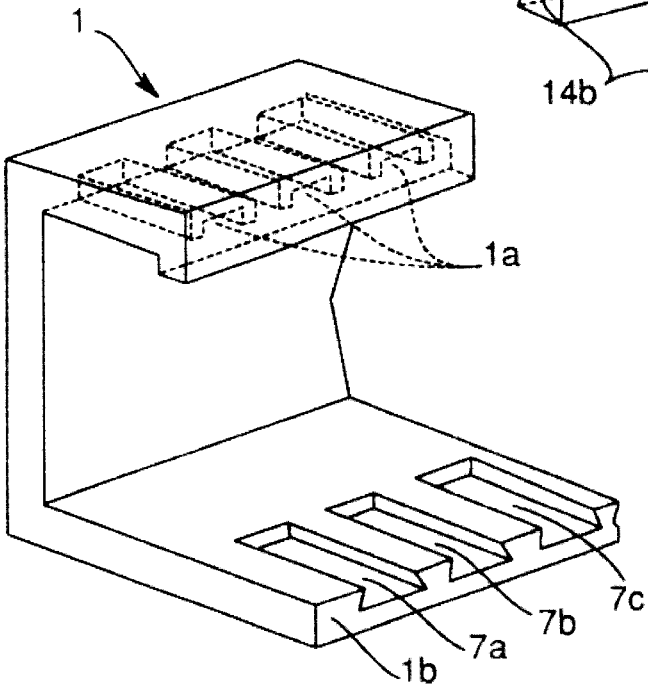
Figure 7:
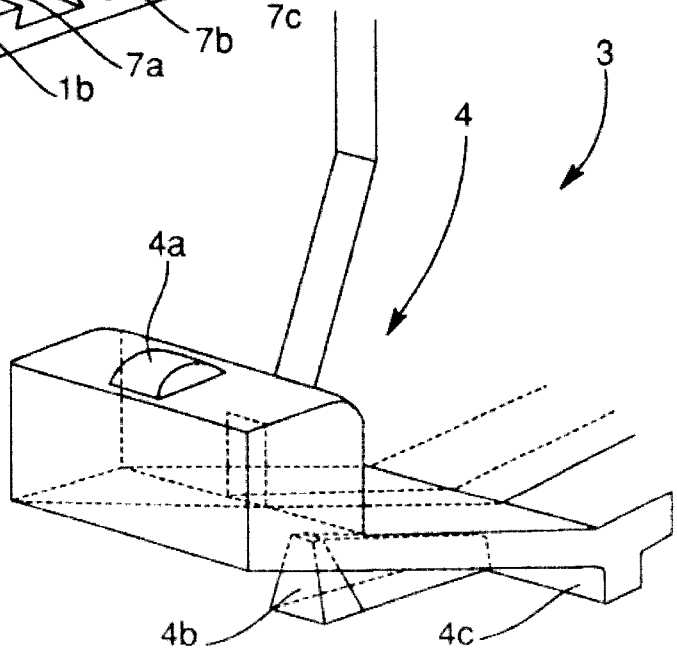

In FIGS. 5 to 7 are shown in greater detail a front portion of the rail 1 and front end portion 14 and 4 of a strip.

On the front end 14 of the strip-pusher 8, the return spring 11 is not shown for purposes of clarity. After emplacement, the securement of this return spring 11 takes place by insertion of its front end into the slot 13*a* of the floor 13 and bending this front end to form a holding hook.

To balance the pressure of the spring 11, each pusher strip 8 is positioned by its ends 14*a* into hollow portions 1*a* of the front rail 1 spaced by about the width of the floor 13, whilst its snap-in tenons 14*b* are also adapted to be snapped into configurations 7*a*, 7*c* forming the mortise of the front rail 1 spaced by a width about the width of the floor 13.

The front end 4 of the separation strip 3 is shown without its flaps 16*a*, 16*b*, of flexible material and has a single positioning lug 4*a* in a corresponding hollow 1*a* of the front rail 1 and a single tenon 4*b* for snapping into a mortise 7*b* of the front rail 1.

Thus, after having engaged the forward heads, either of a pusher strip 8, or of a separation strip 3, there can be carried out a pivoting until the wall 14*c* or 4*c* comes into abutment against the wall 1*b* of the front rail 1, while being ensured a perfect perpendicularity of a strip 3 or 8 forming a cross piece relative to the front rail 1.

Because of the pivoting that takes place in a plane perpendicular to the front rail 1, all the strips 3 or 8 positioned relative to the front rail 1 are thus parallel and the rest after snapping in, which permits obtaining a desired appearance of the display, by the invention.

Figure 9:
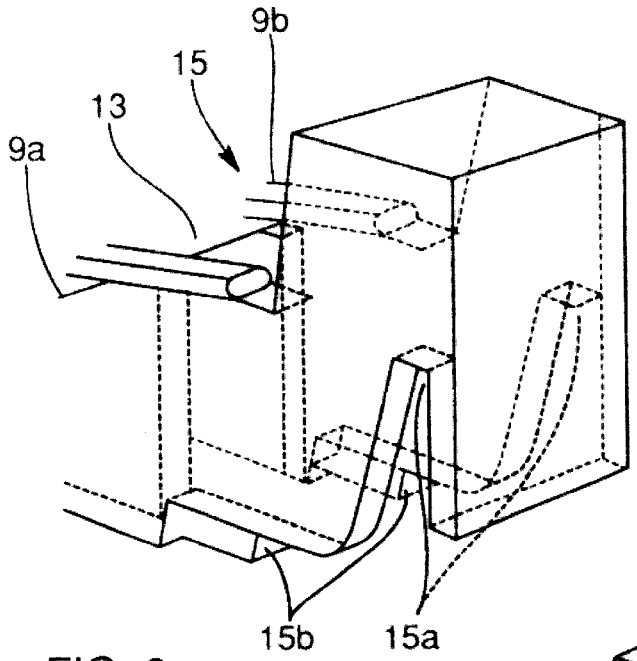
FIGS. 8 to 10 show schematically partial perspective views of rear portions of the device according to the invention.
Figure 8:
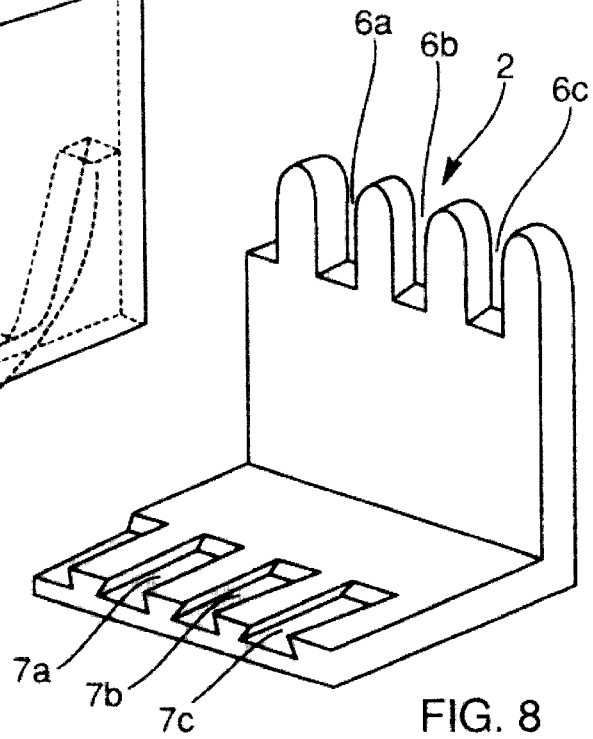
Figure 10:
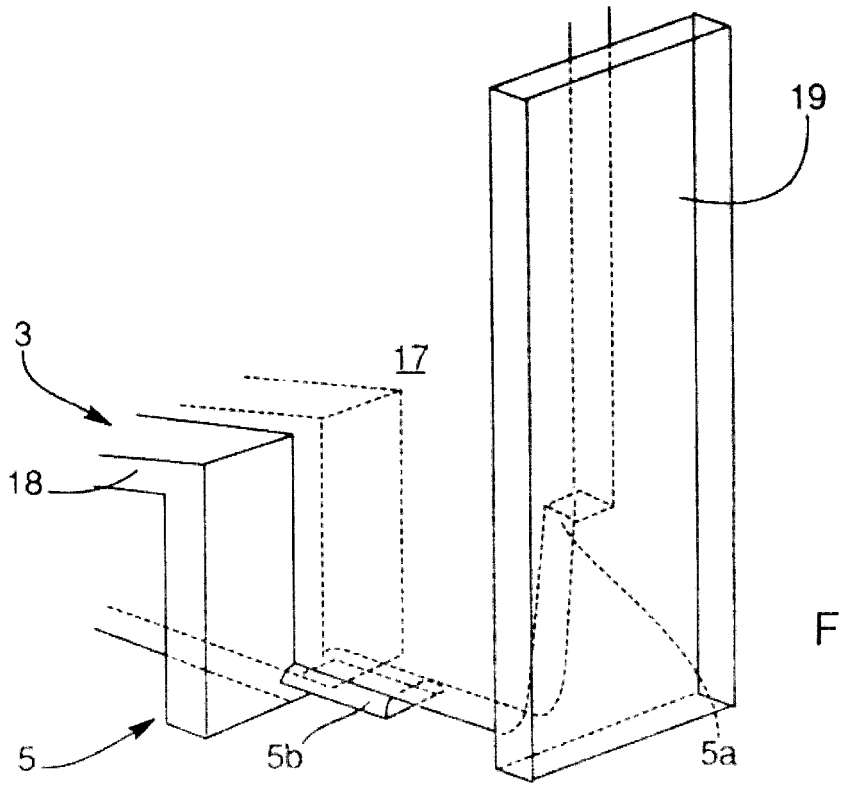

In FIGS. 8 to 10, are shown in greater detail the rear portion of the rear rail 2 and portions of the rear end 15 and 5 of adjustment.

A rear rail portion 2 has a substantially L shaped cross section and comprises indexing notches 6*a*, 6*b*, 6*c* and snap-in mortises 7*a*, 7*b*, 7*c*.

The indexing notches 6 are provided on a substantially vertical wing of the L shaped cross section of the rear rail 2, whilst the snap-on mortises 7*a*, 7*b*, 7*c* are located on the substantially horizontal wing of the rear rail 2.

The rear end 15 of a pusher strip 8 comprises two indexing notches 15*a* and two snap-in tenons 15*b*. The snap-in tenons 15*b* are adapted to coact with the mortises 7*a*, 7*c* spaced from the rear rail, after the indexing means 15*a* have been engaged in the space notches 6*a*, 6*c* of the rear rail 2. To ensure good stability to the rear of the device, there is also provided, analogously to what was said previously, that the spacing of the indexing means 15*a* and of the snap-in means 15*b*, as well as the indexing lugs 6*a*, 6*c* and the snap-in mortises 7*a*, 7*c* will be near or greater than those of the floor 13 for sliding of the spring 11.

The floor 13 is bordered by two lateral ribs 9*a*, 9*b* forming a slideway and a pusher path for a pusher 10 (not shown).

The rear end 5 of a separation strip 3 comprises the elbowed end of a rib 18 for sliding of the products, a snap-in tenon 5*b*, and a securement means 5*a* disposed between the rear end of the wall 17 and an end abutment plane 19 fixed to the wall 17. The end plane 19 delimits with a cutout in the wall 17, the notch Sa for indexing adapted to hook together with an indexing notch 6 of a rear rail 2. After engagement, the plane 19 comes to engagement behind the vertical track of the rear rail 2 and thus retains the separation strip 3 against any forward traction force, particularly during passage of the product over the flexible flaps 16*a*, 16*b*.

The invention described with reference to a particular embodiment is not thereby limited, but covers on the contrary all modifications and variations of shape and all altered embodiments, within the scope of the spirit of the invention.

What is claimed is:

1. A system for the display of products for sale, comprising in combination:

two spaced rails; and strips for forming cross pieces positioned between said rails, each rail comprising at least one snap-in means for snapping in at least one of the strips and at least one positioning means;

wherein each strip comprises a head for engagement and positioning relative to a first rail of the two rails so as to engage in the positioning means of the first rail and to pivot the strip about the head to permit indexing of the respective strip to a second rail of the two rails and wherein each strip further comprises an indexing end adapted to index the strip with respect to the second rail before snapping in of the strip in the two rails, wherein the first rail of the two rails has a substantially J shaped cross section and the positioning means of the first rail are located on the small leg of the J cross section and the snap-in means of the first rail are located on the large leg of the J cross section.

2. The system according to claim 1, wherein the snap-in means comprises at least one mortise configuration for snappingly receiving an edge of the strip and the positioning means is non-coplanar with said snap-in means.

3. The system according to claim 1, wherein the second rail of the two rails has a substantially L shaped cross section.

4. The system according to claim 1, wherein the rails and the strips are shaped to position each strip relative to the first rail of the two rails, and pivot each strip with respect to the first rail to index each strip relative to the second rail of the two rails.

5. The system according to claim 4, wherein the snap-in means of the rails and edges of the strips are so shaped as to interact only after the positioning and indexing of rails and of the strips.

6. A system for the display of products for sale, comprising in combination;

two spaced rails; and strips for forming cross pieces positioned between said rails, each rail comprising at least one snap-in means for snapping in at least one of the strips and at least one positioning means:

wherein each strip comprises a head for engagement and positioning relative to a first rail of the two rails so as to engage in the positioning means of the first rail and to pivot the strip about the head to permit indexing of the respective strip to a second rail of the two rails, wherein each strip further comprises an indexing end adapted to index the strip with respect to the second rail before snapping in of the strip in the two rails, wherein a second rail of the two rails has a substantially L shaped cross section and the positioning means of the second rail comprise indexing means located on one leg of the L shaped cross section, and the snap-in means are located on the other leg of the L shaped cross section.

7. The system according to claim 6, wherein the snap-in means comprises at least one mortise configuration for snappingly receiving an edge of the strip and the positioning means is non-coplanar with said snap-in means.

8. The system according to claim 6, wherein the rails and the strips are shaped to position each strip relative to the first rail of the two rails, and pivot each strip with respect to the first rail to index each strip relative to the second rail of the two rails.

9. The system according to claim 8, wherein the snap-in means of the rails and edges of the strips are so shaped as to interact only after the positioning and indexing of rails and of the strips.

* * * * *